United States Patent [19]

Sano

[11] Patent Number: 4,726,417

[45] Date of Patent: Feb. 23, 1988

[54] ADAMITE COMPOUND ROLL

[75] Inventor: Yoshikazu Sano, Kitakyushu, Japan

[73] Assignee: Hitachi Metals, Ltd., Japan

[21] Appl. No.: 906,405

[22] Filed: Sep. 12, 1986

[51] Int. Cl.[4] ..... B22D 11/12; B22D 19/00

[52] U.S. Cl. ..... 164/448; 164/461; 164/98; 29/132; 29/148.4 D; 148/3; 148/15.5; 148/127; 420/15; 420/108; 428/683

[58] Field of Search ..... 164/448, 92.1, 98, 461; 29/132, 148.4 D; 148/3, 15.5, 127; 420/15, 105, 108; 428/683

[56] References Cited

U.S. PATENT DOCUMENTS

| | | | |
|---|---|---|---|
| 3,455,372 | 7/1969 | Yamamoto | 164/92.1 |
| 3,968,551 | 7/1976 | Miyashita | 29/132 |
| 4,000,010 | 12/1976 | Sekimoto et al. | 29/148.4 D |
| 4,165,407 | 8/1979 | Endoh et al. | 29/148.4 D |

*Primary Examiner*—Nicholas P. Godici

*Assistant Examiner*—Samuel M. Heinrich

*Attorney, Agent, or Firm*—Finnegan, Henderson, Farabow, Garrett & Dunner

[57] ABSTRACT

A compound roll for rolling composed of a shell made of adamite having a carbon content of 1.4–2.5 weight % and a core made of forged or cast steel, the shell being metallurgically bonded to the core by casting an adamite melt around the already prepared core, and the shell having a large residual compressive stress. The adamite shell has a composition consisting essentially, by weight, of 1.4–2.5% of C, 0.6–0.8% of Si, 0.8–1.0% of Mn, 0.5–2.5% of Ni, 1.0–4.0% of Cr, 0.2–2.0% of Mo and the balance being essentially Fe. The residual compressive stress of the shell is desirably at least 20 kg/mm$^2$ so that cracks are effectively prevented from penetrating into the depths of the shell, thereby preventing the breakage of the compound roll at a roll body thereof.

5 Claims, 3 Drawing Figures

ADAMITE COMPOUND ROLL

BACKGROUND OF THE INVENTION

The present invention relates to a compound roll composed of a shell and a core, and more particularly to an adamite compound roll composed of a high-strength, high-toughness, low-alloy cast iron or steel shell and a cast or forged steel core.

Rolls for hot and cold rolling are conventionally formed from alloy cast iron or hardened forged steel, but they suffer from various problems such as low resistance to wear and failure. For the purpose of improving the toughness of rolls, adamite rolls were developed.

Due to the recent advancement of steel rolling, rolls have been used under increasingly severer conditions. Thus, the adamite rolls were sometimes forged to disperse carbides and to make matrix grains finer. The forging is effective for improving the strength and toughness of the adamite rolls, but the forged adamite rolls are expensive, and the forging still fails to attain sufficient strength at neck portions of the rolls. To improve the strength of the neck portions too, low-carbon adamite actually had to be used with the wear resistance of roll bodies sacrificed.

Recently, a centrifugal casting method was attempted to manufacture adamite compound rolls. See J. Honda et al., "Compound Cast Rolls for Steel Rolling Mills," IMONO (Casting), Vol. 54, pp. 44–50, 1982. However, the centrifugal casting method has turned out to be unsatisfactory, because it failed to provide compound rolls having sufficiently hard shells and sufficiently tough cores. Specifically, adamite compound rolls manufactured by the centrifugal casting method had cast cores, so that the cores' mechanical properties were lower than required.

In addition, conventional four high mills comprising a pair of work rolls and a pair of back-up rolls have been increasingly replaced by six high mills having intermediate rolls between work rolls and back-up rolls, or mills having work rolls which can be shifted, in order to apply higher pressure to metal sheets to be rolled. Because an extremely high load is applied to the work rolls, the maximum contact pressure of the work rolls can reach, for instance, up to 240 kg/mm$^2$ as compared with 160 kg/mm$^2$ for the four high mills. At the same time, in such high-pressure mills, a larger bending force is applied to the shafts of the work rolls, so that the roll shafts have been required to have high mechanical strength.

In view of the above problems with the centrifugal casting method, a method of forming a shell around a core by casting a shell material around the core was recently developed.

U.S. Pat. No. 3,455,372 issued to Yamamoto on July 15, 1969 discloses a continuous padding method using high frequency current. This method comprises preheating the surface of a core material by moving the core material up and down through a mold assembly composed of a heating mold, a buffer mold and a cooling mold, and after returning the core material to a predetermined position, moving it downwardly and slowly through the mold assembly while pouring a melt of padding material into the gap between the core material and the mold assembly, whereby the melt is bonded to the surface of the core material, cooled to some extent within the buffer mold, and further cooled and solidified rapidly within the cooling mold to form a layer of pad on the surface of the core material.

This method, which may be called simply "shell casting method," can provide a compound roll composed of a hard shell and a tough core. Adamite compound rolls manufactured by the shell casting method are subject to heat treatment. However, a usual heat treatment comprising hardening and tempering fails to achieve the maximum properties which these compound rolls potentially have. Particularly, cracking which may lead to breakage of roll bodies remains to be a serious problem for the adamite compound rolls thus manufactured.

OBJECT AND SUMMARY OF THE INVENTION

An object of the present invention is, therefore, to provide a compound roll composed of an adamite shell and a forged or cast steel core, which has a highly improved toughness and resistance to cracks without deteriorating its resistance to wear, surface roughening and adhesion of rolled materials.

Another object of the present invention is to provide an adamite compound roll for hot and cold rolling composed of an adamite shell and a forged or cast steel core, which in addition to the above characteristics, is mechanically strong enough to withstand extremely high rolling pressure and bending force without suffering from any breakage at neck portions thereof.

In view of the above object, the inventors have done intense research. As a result, it has been found that a large compressive stress in the adamite shell is highly effective for preventing cracks from penetrating into the depth of the shell, thus preventing the breakage or failure of the compound roll at a roll body thereof. The present invention is based on this finding.

This is, the compound roll according to the present invention is composed of a shell made of adamite having a carbon content of 1.4–2.5 weight % and a core made of forged or cast steel, the shell being metallurgically bonded to the core by casting an adamite melt around the already prepared core, and the shell having a large residual compressive stress.

BRIEF DESCRIPTION OF THE INVENTION

FIG. 1 is a cross-sectional view of a mold assembly for manufacturing the compound roll according to the present invention; and FIGS. 2 and 3 are respectively graphs showing heat treatment conditions for providing the shells of the compound rolls with a large residual compressive stress.

DESCRIPTION OF THE PREFERRED EMBODIMENT

Figure 1:
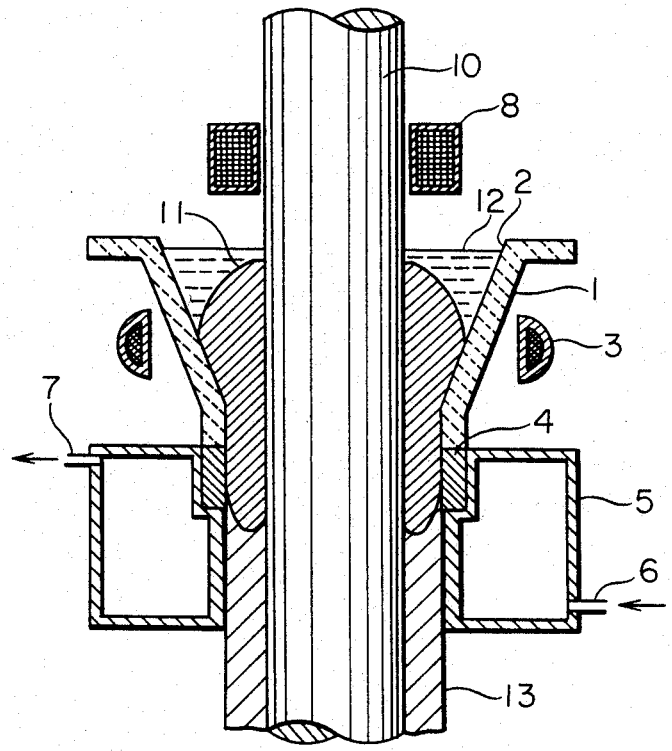

Adamite used as a shell material for the compound roll according to the present invention should have high resistance to wear, adhesion of rolled materials and surface roughening. Specifically, the adamite shell material consists essentially, by weight, of 1.4–2.5% of C, 0.6–0.8% of Si, 0.8–1.0% of Mn, 1.0–4.0% of Cr, 0.2–2.0% of Mo, 0.5–2.5% of Ni and the balance being essentially Fe. Up to 2 weight % of V may be contained, if necessary. With this composition, the adamite shell of the compound roll has Shore hardness of 45 or more. As for the core, it is made of cast or forged steel having tensile strength of 55 kg/mm$^2$ or more and elongation of 0.5% or more. The shell and the core are metallurgically bonded to each other by the shell casting method with bonding strength at least equal to or higher than the strength of either weaker one of the shell and the core.

With respect to the above shell composition of the compound roll, C is 1.4–2.5 weight %. When it is less than 1.4 weight %, the shell of the compound roll does not have sufficient wear resistance because it cannot form a sufficient amount of carbides. However, when it exceeds 2.5 weight %, the shell shows poor mechanical properties due to the excessive formation of carbides.

Si is added as a deoxidizer. When it is less than 0.6 weight %, it cannot provide sufficient deoxidizing effect. But when it exceeds 0.8 weight %, it deteriorates the mechanical properties of the shell. Thus, Si is 0.6–0.8 weight %.

Mn is added for desulfurization and for enhancing hardenability. When it is less than 0.8 weight %, such effect is insufficient, and when it exceeds 1.0 weight %, the shell has poor mechanical properties.

In order that the shell has high Shore hardness which drops slightly across the depth of the shell, Ni should be contained in the shell. However, Ni serves to decrease the resistance of the shell to adhesion of rolled materials. Particularly, when Ni is more than 2.5 weight %, residual austenite exists in the shell, leading to poor resistance to adhesion of rolled materials and surface roughening. Thus, the amount of Ni added to the shell is limited to 0.5–2.5 weight %.

Cr is 1.0–4.0 weight %. It is important to maintain wear resistance of the shell by the formation of $Fe_3C$ type carbides and hardening. When it is less than 1.0 weight %, the shell has poor wear resistance, and when it exceeds 4.0 weight %, it provides poor mechanical properties.

Mo is necessary for enhancing a high-temperature hardness of the shell. When it is less than 0.2 weight %, such effect is insufficient, but when it exceeds 2.0 weight %, residual austenite undesirably remains. Thus, Mo is 0.2–2.0 weight %.

The shell of the compound roll may contain up to 2 weight % of V to improve wear resistance thereof by the formation of VC carbides. However, when it exceeds 2 weight %, the amount of $Fe_3C$ carbides decreases, resulting in the decrease in wear resistance.

With respect to the core of the compound roll for hot rolling, it is made of cast or forged steel having tensile strength of 55 kg/mm$^2$ or more and elongation of 0.5% or more. This core enables the compound roll to withstand high rolling pressure and bending force which are concentrated at neck portions thereof.

The compound roll of the present invention, either for hot rolling or for cold rolling, is manufactured by a so-called shell casting method. This method is typically carried out by a mold assembly shown in FIG. 1.

The mold assembly for the shell casting method comprises a heating mold 1 made of a refractory material having a funnel-shaped upper opening 2, an induction heating coil 3 provided around the heating mold 1, a graphite buffer mold 4 having the same inner diameter as that of the heating mold 1 and concentrically mounted therebeneath, and a water cooling mold 5 partially surrounding the graphite buffer mold 4 and concentrically extending therebeneath. The water cooling mold 5 has an inlet 6 and an outlet 7 through which water flows in the direction shown by the arrow. Provided concentrically above the heating mold 1 is an induction preheating coil 8.

A core 10 is inserted into the mold assembly after being preheated by the induction coil 8. Poured into the gap between the inner surface of the mold assembly and the core 10 is molten adamite 11. The molten adamite 11 is covered by a flux 12 and heated while stirring by the induction heating coil 3 so that it is metallurgically bonded to the core 10. The molten adamite 11 is cooled by the water-cooling mold 5 in the vicinity of the graphite buffer mold 4. The solidified adamite forms a shell 13 strongly bonded to the core 10. Because the core 10 is slowly moved downwardly, adamite is solidified continuously so that the shell 13 is continuously formed around the core 10. New molten adamite is replenished to make up for the consumed one.

The compound roll thus manufactured is subjected to a special heat treatment.

The adamite compound roll is first subjected to a diffusion treatment after the shell casting. The diffusion treatment comprises heating the adamite compound roll at 1000°–1100° C. for 10 hours or more. The adamite shell does not have a uniform microstructure as cast, being filled with acicular, brittle carbides. To make uniform this microstructure, the diffusion treatment is carried out. When the diffusion temperature is less than 1000° C., sufficient diffusion cannot be achieved, and when it exceeds 1100° C., the microstructure of the adamite shell is turned coarser. The diffusion time may vary depending on the size and composition of the roll, but it should be at least 10 hours for sufficient diffusion. This diffusion treatment serves to have the acicular, brittle carbides dissolved in the shell matrix and have the components diffused uniformly.

After the diffusion treatment, a treatment may be carried out to turn carbides in a pearlite matrix, so-called pro-eutectoid carbides spheroidal. This spheroidizing treatment serves to enhance the toughness of the adamite shell. Specifically, the spheroidizing treatment comprises heating at 400°–550° C. for one hour or more for making the roll temperature uniform and then heating to 800°–950° C. and keeping at such temperatures for 5 hours or more for spheroidizing. The spheroidizing time may vary depending on the composition of the adamite shell, but it should be 5 hours or more for sufficient spheroidizing.

The hardening and tempering of the adamite compound roll is carried out in two ways for providing a pearlite matrix and a bainite matrix, respectively.

With respect to a heat treatment for the pearlite matrix, the compound roll is subjected, after the diffusion treatment and if necessary spheroidizing treatment, to heating at 850°–1000° C. for one hour or more for hardening, quenching from the hardening temperature to 600° C. over 15–30 minutes and to 500° C. over 30–60 minutes. The hardened compound roll is further cooled to 400°–550° C. and kept at such temperatures for one hour or more to make the roll temperature uniform, and then reheated to 550°–650° C. and kept at such temperatures for one hour or more. This heat treatment provides the shell the compound roll with a microstructurally stable pearlite matrix.

When the hardening temperature is less than 850° C., sufficient hardening cannot be achieved, and when it exceeds 1000° C., grains in the microstructure of the shell becomes coarse. Thus, it is 850°–1000° C. The hardening time may vary depending on the size and composition of the roll, but it should be at least one hour to achieve sufficient solution of carbides in the matrix.

The quenching is carried out at such a rate as to prevent excessive pearlite transformation and to generate thermal stress which leads to residual compressive stress during the quenching. Specifically, the quenching rate is such that cooling from 850°-1000° C. to 600° C. and to 500° C. takes 15-30 minutes and 30-60 minutes, respectively. Excessive quenching rate leads to large thermal stress, resulting in the cracking of the compound roll during the heat treatment. On the other hand, when it is too slow, excess pearlite transformation takes place during the quenching, resulting in insufficient hardness and residual compressive stress in the shell. The temperature to which the compound roll is quenched may vary depending on the composition of the shell, but it is 400°-550° C. for the compound roll of the present invention. When it is less than 400° C., bainite transformation takes place, making it difficult to obtain microstructurally stable pearlite matrix. And when it is higher than 550° C., excess pearlite transformation takes place during the quenching, resulting in poor hardness. The time period for which the compound roll is kept at 400°-550° C. may vary depending on the size of the compound roll, but it is one hour or more for those for rolling.

The tempering temperature is such that the matrix easily undergoes pearlite transformation. When it is less than 550° C., the pearlite transformation is unlikely to take place, and when it is higher than 650° C., the matrix becomes soft. Therefore, the tempering temperature is 550°-650° C. The tempering time may vary depending on the size and composition of the shell, but it should be one hour or more for the compound roll of the present invention because if otherwise sufficient pearlite transformation would not take place.

Another heat treatment is for providing the adamite shell of the compound roll of the present invention with a bainite matrix. This heat treatment comprises a diffusion treatment at 900°-1000° C. for one hour or more, cooling to 200°-400° C., keeping at such temperatures for one hour or more to make the roll temperature uniform, reheating to 450°-550° C. and then keeping thereat for one hour or more.

With respect to the hardening, when it is less than 900° C., sufficient hardening cannot be achieved, and when it is higher than 1000° C., the grains become undesirably coarse.

With respect to the quenching, it is essentially the same as mentioned above in connection with the pearlite transformation. Specifically, quenching from the hardening temperature to 600° C. takes 15-30 minutes, and quenching from the hardening temperature to 500° C. takes 30-60 minutes. The cooling from 500° C. to 200°-400° C. is conducted at a rate of 20°-100° C. per hour to cause bainite transformation. In this case, the compound roll may be kept at 450°-500° C. for making its temperature uniform and then cooled to 200°-400° C. It is kept at 200°-400° C. for one hour or more for making its temperature uniform.

The tempering temperature is such that residual compressive stress is not relieved and softening does not take place. Thus, it is within the range of 450°-550° C. The tempering time is one hour or more.

The above heat treatments can provide the shell of the compound roll with a residual compressive stress of 20 kg/mm$^2$ or more. It is noted that with this level of the residual compressive stress, cracks such as heat cracks or bending cracks do not penetrate into the depths of the shell, so that breakage of a roll body due to the cracks can be effectively prevented. Accordingly, in the case of sheet rolling, for example, the cracks do not reach the depth at which shear stress caused by contact with the opposing intermediate roll or back-up roll becomes a maximum. The depth at a maximum shear stress may vary depending on the Young's modulus of the shell and the diameter of the roll, but it is usually 2-5 mm.

Because of the residual compressive stress in the shell, the core should have tensile strength of 55 kg/mm$^2$ or more. First of all, the compressive stress in the shell is likely to generate a tensile stress of about 20 kg/mm$^2$ in the core. Thermal stress is also applied to the compound roll when used for hot rolling, generating a compressive stress of 10 kg/mm$^2$ or more in the shell and a tensile stress substantially on the same level in the core. In total, 55 kg/mm$^2$ or more in tensile strength is considered necessary for the core with some margin for safety. In addition to the tensile strength, the core should also have elongation of 0.5% or more to withstand severe rolling conditions. The same level of mechanical properties are also required for the compound roll shell for cold rolling.

The present invention will be explained in further detail by the following Examples.

EXAMPLE 1

A compound roll was manufactured by a shell casting method using the mold assembly of FIG. 1 from a forged steel core of 300 mm in diameter and 3000 mm in length and shell materials having the compositions as shown in Table 1. The shell materials had carbon contents ranging from hypo-eutectoid to hyper-eutectoid. A shell cast around the core was 110 mm thick for each compound roll. The shell casting conditions are as follows:

| | |
|---|---|
| Adamite melt temperature: | about 1600° C. |
| Shell casting speed: | about 60 mm/min |
| Induction coil 3: | 650 KW |

Incidentally, the forged steel core used had tensile strength of 95.4 kg/mm$^2$ and elongation of 5.3%.

For comparison, a compound roll of the same size and structure was manufactured for each adamite composition by a centrifugal casting method using a ductile cast iron core.

TABLE 1

| | Adamite Composition (wt %) | | | | | | |
|---|---|---|---|---|---|---|---|
| No. | C | Si | Mn | Ni | Cr | Mo | Fe |
| 1 | 0.80 | 0.74 | 0.96 | 1.32 | 1.22 | 0.35 | Bal. |
| 2 | 1.13 | 0.66 | 0.86 | 1.77 | 1.78 | 0.62 | " |
| 3 | 1.42 | 0.77 | 0.91 | 1.13 | 2.22 | 0.44 | " |
| 4 | 1.65 | 0.78 | 0.85 | 2.22 | 2.00 | 1.43 | " |
| 5 | 1.96 | 0.73 | 0.88 | 2.35 | 3.03 | 1.32 | " |
| 6 | 2.38 | 0.72 | 0.93 | 1.93 | 2.25 | 0.77 | " |
| 7 | 2.81 | 0.65 | 0.97 | 2.30 | 2.86 | 0.53 | " |

Figure 2:
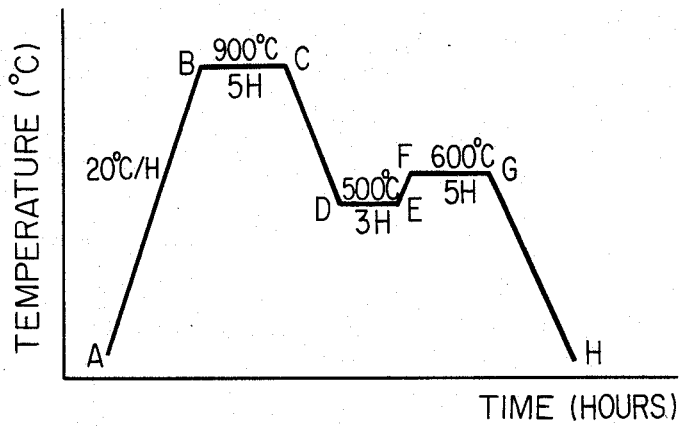
Figure 3:
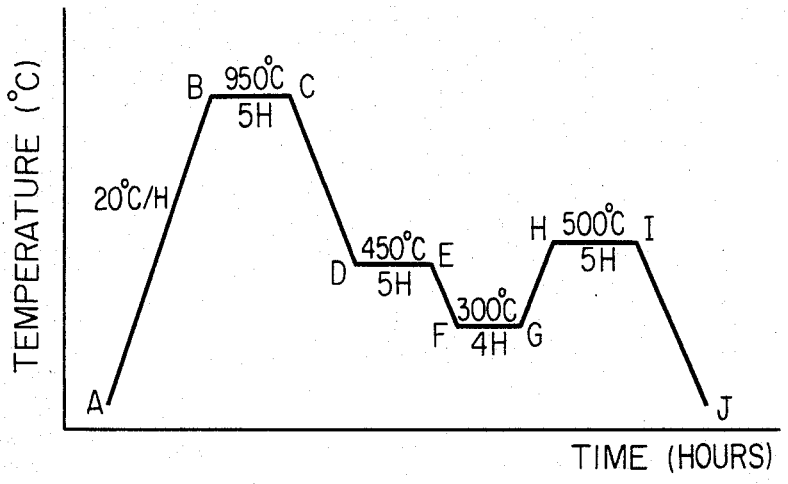

With respect to the resulting compound rolls, Nos. 1, 2, 4 and 7 were subjected to a heat treatment as shown in FIG. 2, and Nos. 3, 5 and 6 to a heat treatment in FIG. 3.

The heat treatment conditions of FIG. 2 were as follows:

AB: Heating to 900° C. at a rate of 20° C./hour.
BC: Keeping at 900° C. for 5 hours for hardening.
CD: Quenching from 900° C. to 500° C. over 40 minutes.
DE: Keeping at 500° C. for 3 hours.
EF: Heating to 600° C. at a rate of 20° C./hour FG: Keeping at 600° C. for 5 hours for tempering.
GH: Cooling to room temperature slowly.

The heat treatment conditions of FIG. 3 were as follows:

AB: Heating to 950° C. at a rate of 20° C./hour.
BC: Keeping at 950° C. for 5 hours for hardening.
CD: Quenching from 950° C. to 450° C. over 45 minutes.
DE: Keeping at 450° C. for 5 hours.
EF: Cooling from 450° C. to 300° C. slowly.
FG: Keeping at 300° C. for 4 hours.
GH: Heating to 500° C. at a rate of 20° C./hour.
HI: Keeping at 500° C. for 5 hours for tempering.
IJ: Cooling to room temperature slowly.

The centrifugally cast compound rolls were also subjected to the heat treatment of FIG. 2 (Nos. 1, 2, 4 and 7) and to that of FIG. 3 (Nos. 3, 5 and 6).

A test piece was machined, along the length of the roll, from the shell of each of the compound rolls 70 mm below the surface. Each test piece was measured with respect to tensile strength and elongation. The results are shown in Table 2.

TABLE 2

| | | Mechanical Properties | | | | | | |
|---|---|---|---|---|---|---|---|---|
| No. | | 1 | 2 | 3 | 4 | 5 | 6 | 7 |
| C Content (wt %) | | 0.80 | 1.13 | 1.42 | 1.65 | 1.96 | 2.38 | 2.81 |
| Tensile Strength ($kg/mm^2$) | Shell Casting | 83 | 84 | 81 | 73 | 57 | 47 | 31 |
| | Centrifugal Casting | 80 | 78 | 62 | 50 | 42 | 39 | 28 |
| Elongation (%) | Shell Casting | 4.9 | 3.8 | 2.9 | 2.1 | 1.2 | 0.7 | 0.2 |
| | Centrifugal Casting | 4.3 | 3.0 | 1.4 | 0.5 | 0.3 | 0.2 | 0.1 |

As is apparent from the above table, the adamite compound roll manufactured and heat-treated according to the present invention have tensile strength and elongation which are respectively 1.2–1.5 times and 2–4 times as high as those of the centrifugally cast adamite compound roll, when the C content is between 1.4–2.5 weight %.

EXAMPLE 2

The compound roll (No. 5) of Example 1 manufactured by the shell casting method was measured with respect to a residual compressive stress by a Sachs method. The results are:

Outer surface (shell): $-26$ $kg/mm^2$
Inner portion (core): 25 $kg/mm^2$

This means that the shell was under a large compressive stress ($-26$ $kg/mm^2$) while the core was under a tensile stress substantially on the same level (25 $kg/mm^2$).

This roll was brought into contact with an aluminum melt at 850° C. for 5 minutes by pouring the aluminum melt into a pool formed on the roll surface, and then quenched with water at 20° C. to form thermal cracks. The cracks thus formed were 0.5 mm deep. On the other hand, after the residual stress was reduced to $-3$ $kg/mm^2$ by cutting the roll to 200 mm long, the same thermal crack test was carried out. As a result, the resulting cracks were 1.2 mm deep, which was about 2.4 times as deep as where the residual stress was $-26$ $kg/mm^2$.

EXAMPLES 3

The compound roll (No. 4) having Shore hardness of 57 of Example 1 manufactured by the shell casting method was tested with resepct to wear resistance. A test piece of 60 mm in diameter and 10 mm in length was machined from the shell of the compound roll, and the wear test was conducted in combination with a cylindrical body of the same size made of S20C (Shore hardness: 28) by a rolling wear test machine. For comparison, the compound roll of the same size (Shore hardness: 55) made from the same adamite by the centrifugal casting method was tested. The test conditions were as follows:

Rotation: $10^6$ at 3000 rpm
Contact pressure: 80 $kg/mm^2$
Slip ratio: 12.9%
Lubricant: Tallow emulsion, one drop/0.6 sec.

The amount of wear measured was 48 mg for the roll according to the present invention and 63 mg for that made by the centrifugal casting method.

As mentioned above, the compound roll of the present invention has high resistance to wear and a large residual compressive stress which serves to prevent cracks such as heat cracks from growing deep in the shell. The compound roll of the present invention further has good mechanical properties such as tensile strength and elongation, so that it is highly resistant to breakage even under severe rolling pressure and bending force. Because of these characteristics, the compound roll of the present invention enjoys a long roll life.

What is claimed is:

1. A compound roll for rolling composed of a shell made of adamite having a carbon content of 1.4–2.5 weight % and a core made of cast or forged steel, said shell being metallurgically bonded to said core by casting an adamite melt around the already prepared core, and said shell having a residual compressive stress of at least 20 $kg/mm^2$ imparted by a heat treatment comprising quenching.

2. The compound roll for rolling according to claim 1, wherein said shell has a pearlite matrix, and the residual compressive stress of said shell is imparted by heat treatment comprising quenching from heating temperature to 600° C. over 15–30 minutes and to 500° C. over 30–60 minutes.

3. The compound roll for rolling according to claim 2, wherein said heating temperature is 850°–1000° C.

4. The compound roll for rolling according to claim 1, wherein said shell has a bainite matrix, and the residual compressive stress of said shell is imparted by heat treatment comprising quenching from heating temperature to 600° C. over 15–30 minutes and to 500° C. over 30–60 minutes.

5. The compound roll for rolling according to claim 4, wherein said heating temperature is 900°–1000° C.

* * * * *